United States Patent [19]

Tezuka

[11] 4,165,687

[45] Aug. 28, 1979

[54] PRINTING EQUIPMENT AND METHOD OF OPERATION THEREOF

[75] Inventor: Chikao Tezuka, Shiojiri, Japan

[73] Assignees: Kabushiki Kaisha Suwa Seikosha; Shinshu Seiki Kabushiki Kaisha, both of Tokyo, Japan

[21] Appl. No.: 798,512

[22] Filed: May 19, 1977

[30] Foreign Application Priority Data

May 22, 1976 [JP] Japan ..... 51/59282

[51] Int. Cl.[2] ..... B41J 1/44

[52] U.S. Cl. ..... 101/93.01; 101/93.22; 101/99; 101/101; 101/108

[58] Field of Search ..... 101/95, 97, 93.01, 98, 101/99, 101, 108, 110, 93.22, 93.37, 359, 362

[56] References Cited

U.S. PATENT DOCUMENTS

| | | | |
|---|---|---|---|
| 701,071 | 5/1902 | Moody | 101/101 |
| 2,384,035 | 9/1945 | Keuper | 101/101 |
| 3,526,309 | 9/1970 | Marion et al. | 101/98 X |
| 3,875,859 | 4/1975 | Busch | 101/99 |
| 3,884,144 | 5/1975 | Shimodaira | 101/99 |
| 3,946,666 | 3/1976 | Yokoyama | 101/110 |
| 3,954,055 | 5/1976 | Hanaoka | 101/95 X |

*Primary Examiner*—Edward M. Coven

*Attorney, Agent, or Firm*—Blum, Moscovitz, Friedman & Kaplan

[57] ABSTRACT

A small-sized printing apparatus which operates at a low noise level and provides good printing quality includes a plurality of printing rings, each having type characters on the peripheral surface thereof. The printing rings are mounted on a shaft which reciprocates for the purpose of bringing a selected character on each of the rings to a printing position. The shaft reciprocates through forward and reverse directions of rotation. An inking roll transfers ink intermittently to the type characters.

10 Claims, 2 Drawing Figures

PRINTING EQUIPMENT AND METHOD OF OPERATION THEREOF

BACKGROUND OF THE INVENTION

As is evident, in printing equipment using type characters, provision must be made for inking the type. For this purpose an inking roll is generally used. Conventionally, a character ring having type characters on the peripheral edge thereof is rotated continuously and an inking roll is brought in contact with said periphery. The mechanism involved in carrying out this process is costly, has relatively short life and must be made with great precision. Such features are undesirable, especially with respect to small-sized printing equipment so that it would be desirable to provide a printing mechanism which is simpler, lower in cost, quiet in operation and long-lasting.

SUMMARY OF THE INVENTION

A shaft mounted for rotation in both forward and reverse directions supports a plurality of printing rings each having type characters on the cylindrical face thereof. The rings are disengageably mounted on the shaft so that each ring can be stopped at a selected printing position without stopping rotation of the shaft. Each of the rings can be stopped at a selected position by sending a signal to a corresponding electro-magnet which operates a ratchet and claw mechanism for stopping the ring at a selected position. The shaft is rotatable through at least two complete turns in one of the two directions, that is, forward or reverse. In executing a turn after the first complete turn, an inking roll is brought in contact with the type characters to transfer ink to same.

Accordingly, an object of the present invention is a printing equipment which is small-sized, quiet in operation, low in cost and of long life.

Another object of the present invention is a small-sized printing equipment of low cost and long life wherein rotation of a shaft in excess of a complete turn is used for transferring ink to the type characters on the cylindrical face of printing rings.

An important object of the present invention is a printing equipment of small size and low cost wherein the steps of bringing a type character into and out of printing position and inking of the type characters on said printing ring are carried out in different rotational turns.

A significant object of the present invention is a method of operating a small-sized printing equipment of low cost and long life wherein the steps of bringing a type character on the face of a printing ring into and out of printing position and inking of the type characters on the cylindrical face of the ring are carried out on different rotational turns of said printing ring.

Still other objects and advantages of the invention will in part be obvious and will in part be apparent from the specification.

The invention accordingly comprises the several steps and the relation of one or more of such steps with respect to each of the others, and the apparatus embodying features of construction, combination of elements and arrangement of parts which are adapted to effect such steps, all as exemplified in the following detailed disclosure, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 1:
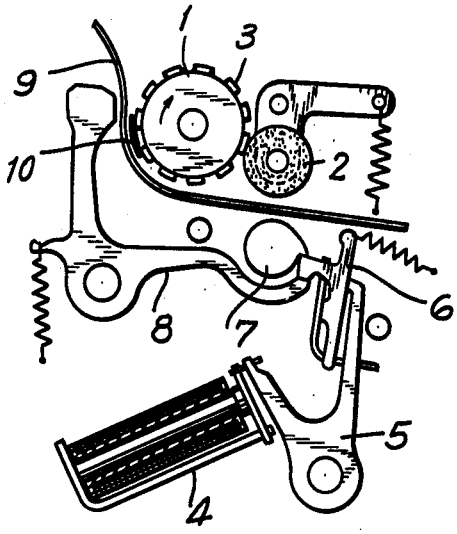
FIG. 1 PRIOR ART
FIG. 1 is a fragmentary side-sectional view of a printing mechanism using a conventional inking roll.

A printing equipment in accordance with the prior art is shown in FIG. 1. The printing drum or cylinder 1 has type characters 3 on the cylindrical face thereof. To transfer ink to the type characters, inking roll 2 is brought in contact with printing drum 1 during continuous rotation of the printing drum. To carry out the printing operation, an electro-magnet 4 drives a selecting claw 5 and a trigger lever 6 in synchronism with the position of the type characters 3. Printing is carried out by striking said type characters with hammer 8 which is driven by the energy of cam 7 when a selected character 3 is in printing position. A mask 10 is placed between the printing drum 1 and roll paper 9, the mask 10 functioning as a spacer so that said roll paper 9 is not stained with the ink transferred from inking roll 2 to the type characters 3.

For this equipment to function satisfactorily, the accuracy with which said mask 10 is constructed must be extremely great. Accordingly, the cost of the mask is high and its durability is low. Moreover, due to the fact that printing is effected by the flying printing method, the impact noise of the hammer 8 against printing drum 1 is great, this constituting a serious disadvantage, especially where the system is to be used in a confined space.

Figure 2:
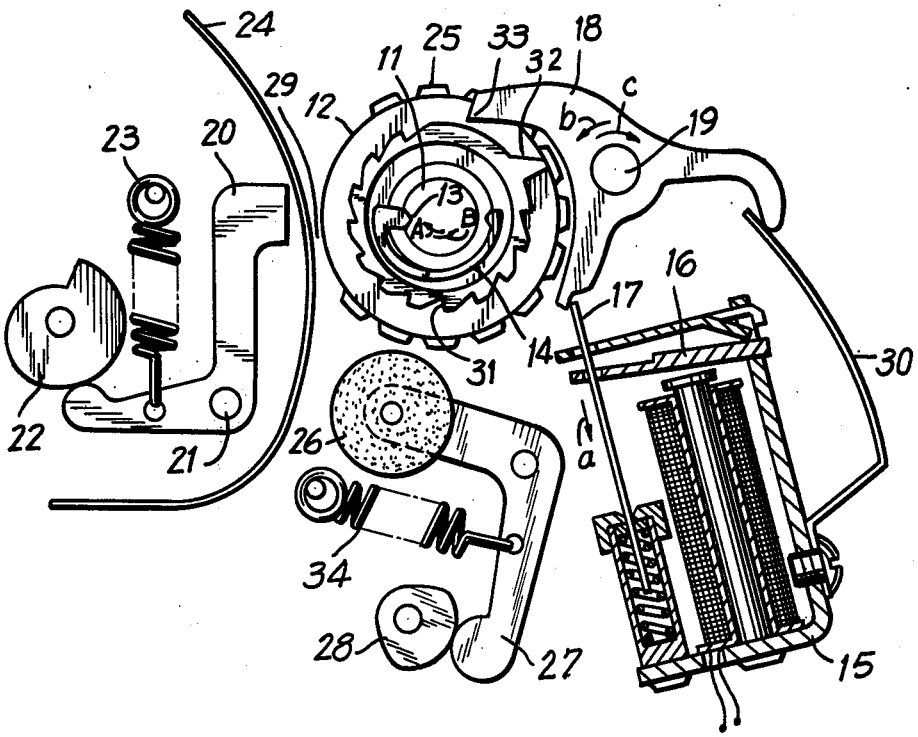
FIG. 2 is a fragmentary side-sectional view of an embodiment of the present invention.

In the embodiment shown in FIG. 2, rotatable shaft 11 supports a plurality of character rings 12, shaft 11 being constructed and arranged for reciprocation in both forward and reverse directions. Shaft 11 has a groove 13 in the thrust direction on its periphery. Friction spring 14 has an end connecting with said groove 13.

Electro-magnet 15 is under the control of a signal which is synchronized with the rotation of shaft 11 for stopping the rotation of a character ring 12 when a selected type character is in printing position. Activation of the electro-magnet 12 attracts suction plate 16 and moves trigger bar 17 in the direction of the arrow a.

Each character ring 12 is associated with a corresponding selecting claw 18, said claw being rotatable about shaft 19.

Printing hammer 20 is supported by hammer shaft 21 and, when the printing operation is to be carried out, it is driven by printing cam 22 against the bias of printing spring 23. Printing is accomplished by pressing roll paper 24 against a type character 25 on the periphery of the corresponding character ring.

Inking roll 26 is mounted on arm 27 which makes contact with cam 28 under the urging of biasing spring 34. Rotation of cam 28 brings inking roll 26 intermittently in contact with type characters 25 for inking same. The inking operation is carried out in synchronism with the rotation of shaft 11 as will be explained.

The first step in the operation of printing is to select a type character on the face of each ring or drum. For this purpose, shaft 11 starts to rotate in the direction of the arrow A. During this stage, character rings 12 are friction-coupled with said grooves 13 of shaft 11 by the force of friction spring 14. Consequently, character rings 12 rotate with said shaft 11. When a desired type character reaches printing position 29, electro-magnet 15 is activated by the passage of current therethrough, trigger bar 17 is pulled in the direction indicated by the arrow a and selecting claw 18 is rotated in the direction of the arrow b under the urging of selecting claw spring 30, said selecting claw 18 engages with a selected saw-blade-type tooth 31 on the side face of said character ring 12, and stops the rotation of said ring. As the rotation of the ring is stopped, said friction spring 14 rides up on the slope of said groove 13 in said shaft as a result of which said shaft 11 can continue to rotate although the rotation of said character ring has been halted.

Selection of a type character is completed, regardless of the character selected, when the shaft 11 has rotated in the forward direction by one turn or slightly less. The engagement of printing cam 22 and printing hammer 21 is released, and printing is carried out by striking all of the characters at the printing position 29 on the plurality of character rings.

When the printing of the selected row of characters is completed, shaft 11 is rotated in the direction of the arrow B, and friction spring 14 which had been riding on the periphery of the shaft during the process of selection of the individual type characters drops back into groove 13. During this step of the process, the character rings 12 rotate in the reverse direction with shaft 11. However, each of the character rings carries a projection 32 which lies in the same plane as the saw blade teeth 21. Consequently, rotation of each of the printing rings stops at the moment that projection 32 engages with end 33 of selecting claw 18. The printing equipment is then in the condition prior to the start of the selection process for repetition of the operation.

Groove 13 in the shaft is so formed that the friction spring 14 does not run on when shaft 11 rotates in the direction of the arrow B. Consequently, when the shaft is rotated further in the B direction, projection 32 rotates selecting claw 18 in the direction of the arrow c against the force of selecting claw spring 30 thereby returning selecting claw 18 to the rest condition by engaging trigger bar 17 and selecting claw 18.

When the return process is finished, inking roll 26 is brought into contact with the type characters by arm 27 and cam 28 operating in cooperation with biasing spring 34, thereby engaging and disengaging inking roll 26. Rotation of shaft 11 through one full turn in the direction of the arrow B insures that ink will be transferred to all of the type characters 25 on the periphery of printing ring 12, thereby completing the transfer of ink.

As aforenoted, the device of the present invention is so constructed that the selection process is carried out during a single turn of shaft 11 in the A direction and the printing process is carried out during the instant when the rings are stopped. The reverse rotation of ring 12 on shaft 11 repositions selecting claw 18 during the first turn in the B direction, and ink transfer is carried out during the second turn in the B direction.

It is possible to vary the construction of the device of the present invention in a number of ways without departing from the spirit thereof. For instance, it is possible to make one turn of shaft 11 in the A direction at the moment of printing, although proceeding in this way increases the total cycle time. Nevertheless, this technique has the merit of simplifying the row of said character rings substantially with respect to the reciprocating turning with shaft 11. Thus, said shaft 11 does not make a complete 360° turn in both the selection process and the return process in relation to the arrangement of said projections 32 of said character rings 12, but each turn is regarded as one turn. As for the other return method for said character rings 12 and selecting claw 18, it is possible to return said selecting claw 18 in combination with other returning members after printing has been finished and to return said character rings 12 by stopping the rotation thereof with the frictional load of the inking roll 26 pressing thereagainst and dropping said friction spring 14 into said groove 13 of said shaft 11. As for another type of printing, the method of pressing a platen against printing types, the method of rolling a platen on printing types while applying pressure, the method of striking printing types with flying hammers by giving impact energy with rotating bodies and still others are also possible.

The inking roll 26 is generally kept in the disengaged state in the case of a one-body roll so that a frictional load is not applied to said character rings 12 during the type-selecting process as aforenoted. However, it is possible to construct said inking roll 26 and character rings 12 so that they always come in contact by setting the torque of said shaft 11 and the force of said friction spring 14 at high values. Further, by selecting a soft material or a material with small resistance when in contact with character rings 12 or said inking roll 26 it is possible to increase the capacity for transferring ink to the type characters 25.

In the operation of the printing device in accordance with the present invention, the noise involved becomes very low because of the method by which the selection of the character on the character ring is carried out. Moreover, the roll paper is never stained because only one line is printed at a time while the character rings are completely stopped at the printing position. Moreover, a mask is not required as is the case when using flying type and a large reduction in cost results as compared with flying type. Further, the type of print which results when the ink is transferred to the type characters by inking rolls is several times as clear as those obtained with ink ribbons which have been used especially in the printing mechanism of the printing type ring selection method so far. Also, the construction with inking rolls can reduce the number of parts so that the overall size of the equipment is smaller and the cost as compared with ink ribbon equipment is greatly reduced.

It will thus be seen that the objects set forth above, among those made apparent from the preceding description, are efficiently attained and, since certain changes may be made in carrying out the above method and in the constructions set forth without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. Printing apparatus, comprising a plurality of character rings each ring having type characters on the periphery thereof, a shaft for supporting and rotating said rings in both the forward and reverse directions in reciprocation, an inking roll for making intermittent contact with said characters on each of said rolls and transferring ink to same, a selecting means for selectively stopping each of said character rings in a printing position, and a printing means disposed in registry with said printing position, said shaft being arranged and disposed for rotating through two complete turns in one of said forward and reverse directions for a total of three complete turns, one of said complete turns being in said forward direction and serving for rotating a selected character on each of said rings to said printing position, one of said complete turns being in said reverse direction and serving for return of said rings to a rest position, and one of said turns in said one of said forward and reverse directions serving for transfer of ink to all of said characters, whereby inking of said characters may be effected without interference with the rotation of said character rings and during rotation of said character rings through a full turn.

2. The printing apparatus as defined in claim 1, further comprising reciprocating means for intermittently bringing said inking roll in contact with said characters.

3. The printing apparatus as claimed in claim 2, wherein said reciprocating means includes an arm for holding said inking roll, said arm being pivoted for reciprocation, a cam making contact with said arm and shaped for reciprocating same, and biasing means for holding said arm against said cam.

4. The printing apparatus as claimed in claim 1, wherein said selecting means comprises a ratchet fixed to each of said character rings for rotation therewith, a claw for engaging a selected tooth of each of said ratchets and thereby stopping the corresponding character ring with a selected character in said printing position, activating means for moving said claw into engagement with said selected tooth and biasing means for removing said claw from engagement with said tooth.

5. The printing apparatus as defined in claim 4, wherein said activating means includes a solenoid.

6. The printing apparatus as claimed in claim 1, wherein said printing means includes a printing hammer, biasing means for driving said hammer toward said character ring and a cam for retracting said hammer and releasing same.

7. The printing apparatus as claimed in claim 1, wherein said character rings are disengagingly mounted on said shaft so that said rings can be selectively stopped without stopping the rotation of said shaft.

8. A method of printing wherein a plurality of character rings having type characters on the peripheries thereof are mounted on a shaft for forward and reverse rotation, comprising the steps of rotating said shaft through at least two complete turns in one of said forward and reverse directions, each of said character rings being positioned in a print position by said first turn of said shaft and each of said character rings being maintained in said print position during the second complete turn of said shaft, and bringing an inking roll in contact with said type characters only during said second complete turn of said shaft after a first complete turn of said shaft in one of said directions.

9. A printing apparatus, comprising a drive shaft rotatable in both forward and reverse directions, said drive shaft being arranged and constructed for rotating through two complete turns in one of said forward and reverse directions during one print cycle;

at least one character ring carrying at least one character on the periphery thereof mounted on said drive shaft for rotation therewith during a selection process, a return process and an ink transfer process;

spring means having two ends, one of said ends being releasably connected with said shaft and the other of said ends being connected with said character ring for rotating same in said forward and reverse directions during said selection, return and inking processes;

selection means for selectively locking each of said character rings during the first complete turn of said shaft with a selected character in a printing position without stopping the rotation of said shaft by release of said one end of said spring means, thereby aligning a selected character on each of said character rings in said printing position, said character rings remaining in said printing position during said second complete turn of said shaft;

printing means for impriting said selected characters on an imprint receiver; and an inking roll means operable for making intermittent contact with each of said characters on each of said character rings and for transferring ink to same; and said ink roller means being arranged and constructed for making contact with and transferring ink to said characters only during said second complete turn of said shaft.

10. A printing apparatus as defined in claim 9, wherein said apparatus is designed and constructed for bringing said selected characters from a starting position into said printing position during one complete forward turn, for returning said characters to said starting position during one complete reverse turn, and for bringing said inking roll into contact with said characters during that one of said two complete turns other than that used for bringing said characters from starting to printing position or returning said characters from said printing to said starting position.

* * * * *